United States Patent [19]

Talley et al.

[11] Patent Number: 4,668,009

[45] Date of Patent: May 26, 1987

[54] INCLINER SEAT WITH PUSH BUTTON RELEASE

[75] Inventors: Thomas H. Talley, Downers Grove; Thomas E. Wilson, Glendale Hts., both of Ill.

[73] Assignee: Schnadig Corporation, Chicago, Ill.

[21] Appl. No.: 787,610

[22] Filed: Oct. 15, 1985

[51] Int. Cl.[4] ..... A47C 1/02

[52] U.S. Cl. ..... 297/85; 297/68

[58] Field of Search ..... 297/68, 69, 83, 84, 297/85, 88, 89, DIG. 7

[56] References Cited

U.S. PATENT DOCUMENTS

| | | | |
|---|---|---|---|
| 4,494,793 | 1/1985 | Rogers, Jr. | 297/85 |
| 4,506,926 | 3/1985 | Griggs, Jr. | 297/83 |
| 4,531,778 | 7/1985 | Rogers, Jr. | 297/85 |
| 4,570,995 | 2/1986 | Rogers, Jr. | 297/85 X |

*Primary Examiner*—Kenneth J. Dorner
*Assistant Examiner*—Mark W. Binder

[57] ABSTRACT

An incliner seat assembly includes a vertically slidable push button for releasing the link assembly so that the link assembly can move from its retracted position to its extended position.

4 Claims, 6 Drawing Figures

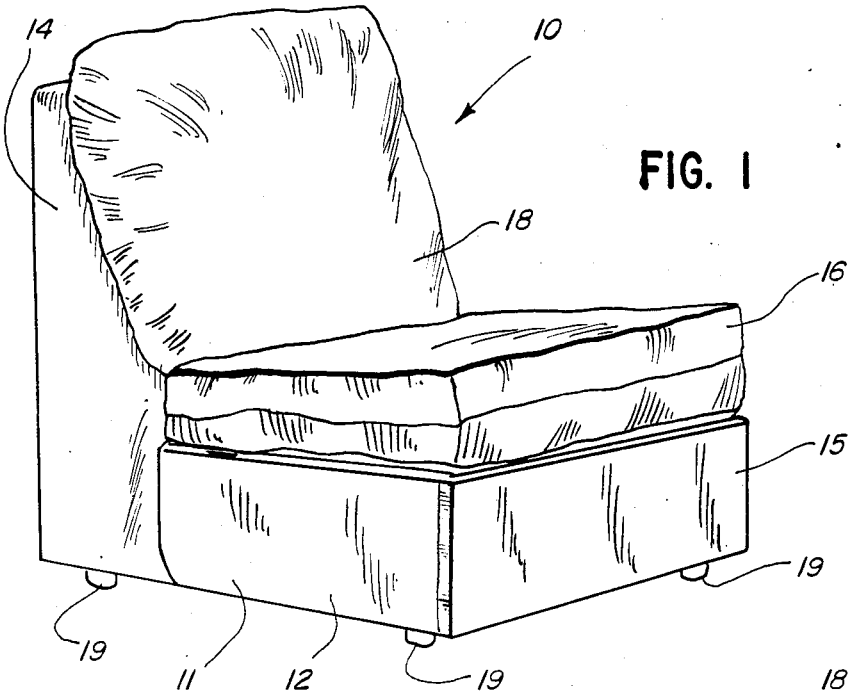
FIG. 1
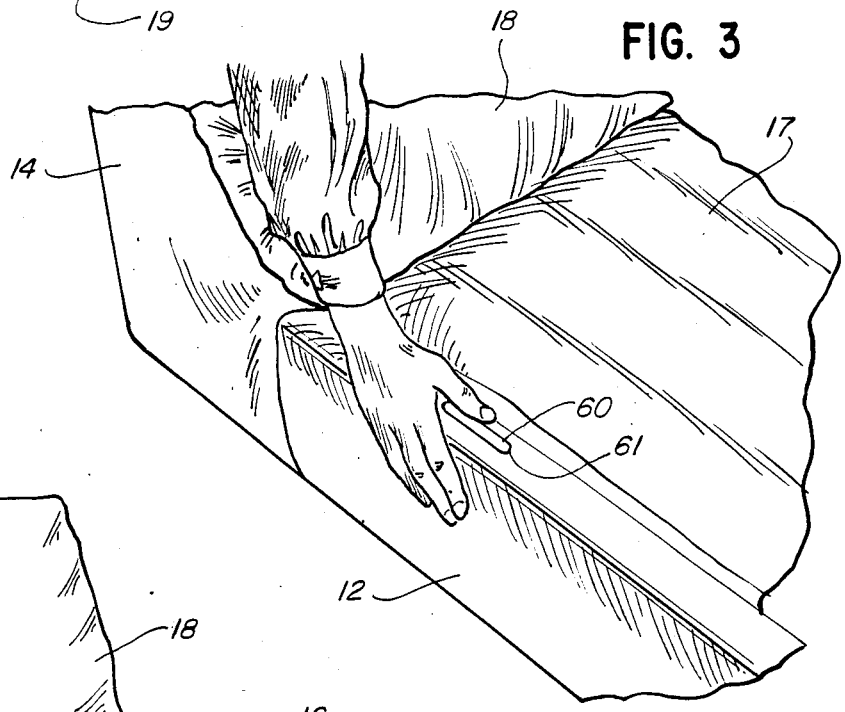
FIG. 3
FIG. 2
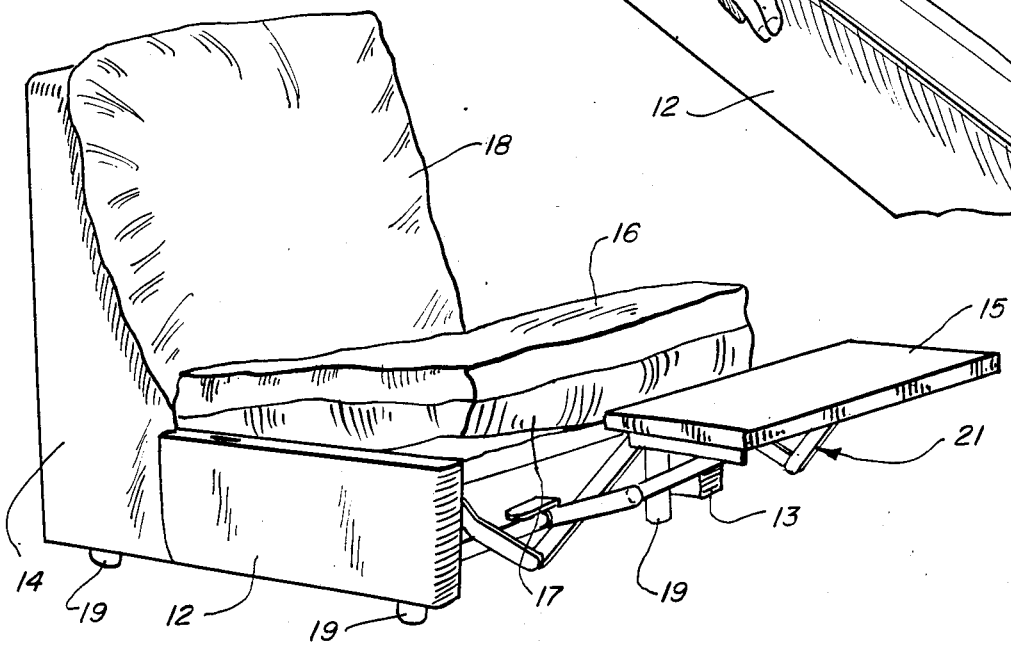

INCLINER SEAT WITH PUSH BUTTON RELEASE

BACKGROUND AND SUMMARY

This invention relates to incliner seats, and, more particularly, to an incliner seat with a vertically slidable push button release.

Incliner seats conventionally include a frame and a link assembly mounted on the frame for movement between a retracted position and an extended position. A seat and a foot rest are supported by the link assembly. When the link assembly is in the retracted position, the foot rest is retracted against the frame and extends generally vertically. When the link assembly is in the extended position, the link assembly supports the foot rest in an extended position away from the frame. The seat may move downwardly and forwardly as the link assembly moves. Recliner seats are similar to incliner seats, but the backrest also reclines. As used herein, the term "incliner seat" is used broadly to refer to both incliner seats and recliner seats.

The conventional link assembly for an incliner seat includes a pair of pivotally connected latch links which can be latched in an overcenter position to retain the link assembly in its retracted position. A release mechanism includes a handle which is pivotally mounted on the outside of the incliner seat and a connecting rod between the handle and one of the latch links for raising the link as the handle is rotated. The exterior handle detracts from the appearance of the incliner seat, can interfere with arranging the seat in a desired location, and presents a potential hazard.

The invention provides a hidden release for the link assembly of an incliner seat. A push button actuator is slidably mounted in the side frame of the incliner seat below the seat cushion. Only the tip of the push button extends above the frame, and the tip can be concealed by the seat cushion. When the push button is depressed, an actuator rod on the push button engages one of the trigger links and moves the latch links overcenter to allow the link assembly to move to its extended position. When the link assembly is returned to the retracted position, the push button slides vertically upwardly. There are no moving parts on the outside of the frame.

DESCRIPTION OF THE DRAWING

The invention will be explained in conjunction with an illustrative embodiment shown in the accompanying drawings, in which FIG. 1 is a perspective view of an incliner seat which is equipped with a push button release mechanism in accordance with the invention;

FIG. 2 illustrates the incliner seat in the extended position;

FIG. 3 is a fragmentary perspective view with the seat cushion removed showing the push button being depressed;

DESCRIPTION OF SPECIFIC EMBODIMENT

Figure 4:
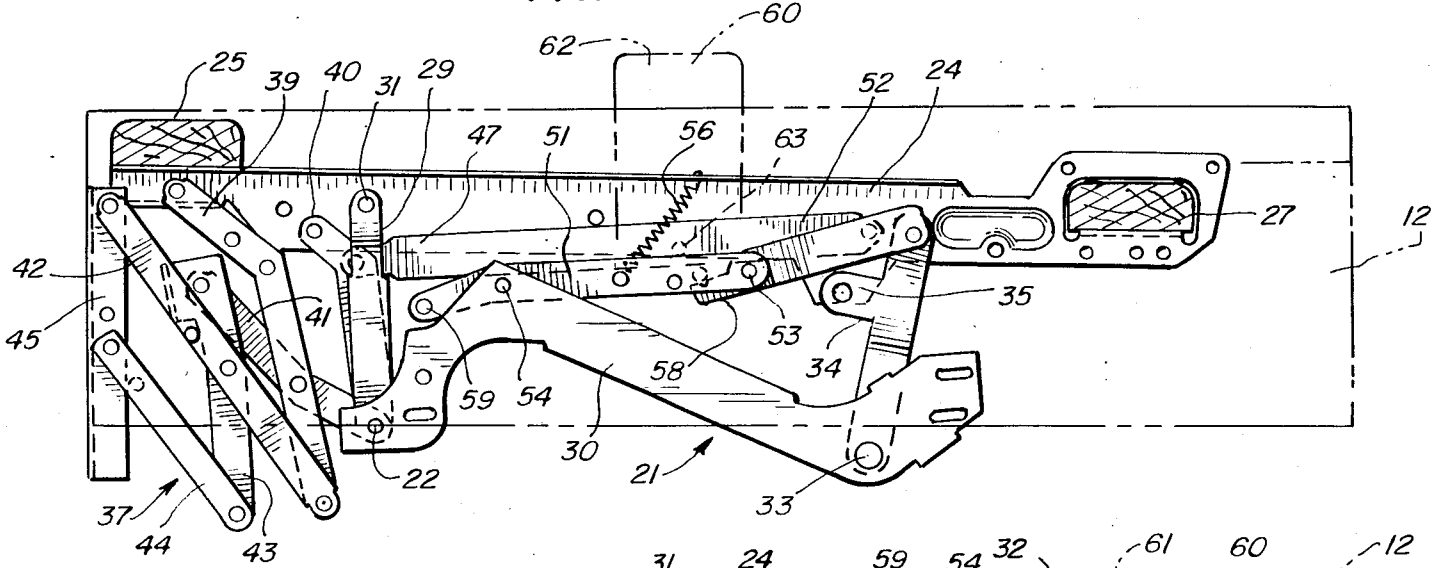
FIG. 4 is a side view of the link assembly in the retracted position.

Referring to FIGS. 1–3, an incliner seat 10 includes a fabric-covered frame 11 which has a pair of side portions 12 and 13 and a back portion 14. A footrest panel 15 extends in front of the side portions in FIG. 1 and is supported in an extended position in FIG. 2. A seat cushion 16 is supported by a seat frame 17 (FIG. 3), and a back cushion 18 is supported by the back portion 14 of the frame. The frame is supported on the floor by four feet 19.

Figure 5:
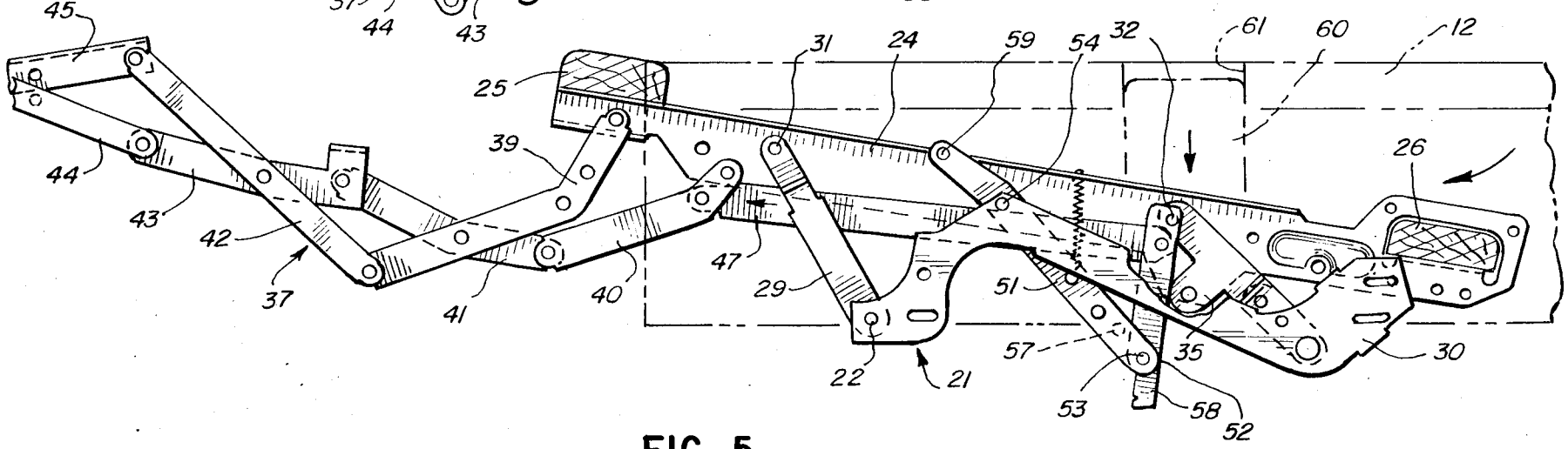
FIG. 5 shows the link assembly in the extended position.

Referring now to FIGS. 4 and 5, a link assembly 21 is attached to each of the side frames 12 and 13. The link assembly is pivotally mounted on the side frame by a pin 22 which is mounted on the frame, and the link assembly is movable relative to the stationary pin 22 between a retracted position shown in FIG. 4 and an extended position shown in FIG. 5.

Each link assembly includes a seat support rail 24 which is positioned laterally inwardly of the side frame and slightly below the upper edge thereof. The seat support rails of the two link assemblies support the seat frame 17. The seat frame 17 includes front and rear wooden slats 25 and 26 which extend between the two link assemblies and are attached to the front and rear ends, respectively, of the seat support rails 24. The rear slat 26 extends into an opening 27 in the rail 24.

The seat support rail 24 is supported for swinging movement by a straight support link 29 which is pivotally supported by the pin 22 and a generally S-shaped support link 30 which is also pivotally supported by the pin 22. The straight support link 29 is pivotally attached to the seat rail 24 by a pin 31. The rear portion of the S support link 30 is pivotally attached to a T-shaped link 32 by a pin 33. A short arm 34 on the T link 32 is pivotally attached to the seat rail 24 by the pin 35.

A footrest link assembly 37 is pivotally attached to the seat rail 34 and supports the footrest 15 (FIGS. 1 and 2). The footrest link assembly includes a pair of generally V-shaped links 39 and 40 which are pivotally attached to the seat rail and pivotally connected links 41 through 45. The footrest 15 is attached to the link 45 of each of the link assemblies. The footrest link assembly is extended and retracted by a pusher link 47 which extends generally parallel to the seat rail 24.

The link assembly 21 is actuated by a pair of latch links 51 and 52 which are pivotally connected by a pin 53. The latch link 51 is pivotally attached to the S link 30 by a pin 54. The latch link 52 is pivotally attached to the pusher link 47 by a pin 54 and is pivotally attached to the upper end of T link 32 by a pin 55.

The latch links 51 and 52 are movable between latched position illustrated in FIG. 4 and an unlatched position illustrated in FIG. 5. The latch link 51 is biased toward the latched position by a spring 56 which is attached to the link 51 and the seat rail 24. The latch links are prevented from moving beyond the latched position by a pin 57 on the link 51 which engages a finger 58 on the link 52.

When the latch links 51 and 52 are in the latched position the T link 32 extends upwardly and rearwardly from its pivot connection 33 at the S link 30. The weight of the seat therefore prevents the T link from pivoting counterclockwise, and the footrest link assembly is retained in its retracted position by the pusher link 47.

The link assembly 21 which has been described up to this point is a conventional incliner link assembly which has been available before this invention. In the conventional incliner the link assembly would be actuated by a vertically extending rod which would be attached to an opening 59 on the left end of the latch link 51. The rod would be attached to a crank which would be rotated by a handle on the outside of the crank to pull the rod upwardly to exert an upward force on the left end of the latch link 51. The latch link 51 would pivot clockwise about the pivot pin 54 on the S link 30, and the link 52 would pivot counterclockwise and pull the T link 32 to the left so that the T link pivoted clockwise about its pivot support 33. When the T link 32 moved past vertical, the weight of the occupant caused the entire link assembly to pivot about the fixed pivot 22 to move from the retracted position in FIG. 4 to the extended position in FIG. 5. The seat rail 24 moves forwardly and becomes inclined from the horizontal, and the pusher link 47 moves forwardly to extend the footrest link assembly.

Figure 6:
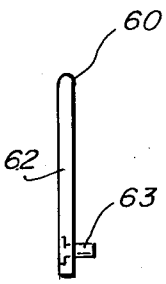
FIG. 6 is a front view of the push button.

In accordance with this invention, a push button 60 is slidably mounted within a slot 61 (FIG. 5) in the side frame 12. Referring to FIGS. 4 and 6, the push button 60 includes a flat panel 62 and an actuator rod 63 which extends perpendicularly from the panel and perpendicularly to the direction of sliding movement. When the link assembly 21 is in the retracted position, the actuating pin 62 engages the upper edge of the latch link 51 adjacent the pivot pin 53, and the upper end of the push button extends slightly above the upper edge of the side frame 12 so that it can be engaged by a finger of the occupant of the seat as illustrated in FIG. 3. FIG. 3 illustrates the incliner with the occupant and the seat cushion 16 removed for clarity of illustration. The push button is actually concealed by the seat cushion 16 as illustrated in FIG. 1.

The occupant operates the push button merely by slipping his thumb under the seat cushion and pushing down on the push button 60. As the push button moves downwardly, the pivot connection 53 of the latch links 51 and 52 is forced downwardly. The pivoting movement of link 52 pivots the T link 32, and when the T link 32 passes a vertical position, the weight of the occupant forces the link assembly to move from its retracted position to its extended position. Only a small downward movement of the push button is required to move the T link 32 overcenter, and only the tip of the push button need be exposed about the side frame 12.

The link assembly can be returned to its retracted position by pushing downwardly and rearwardly on the footrest 15, and the latch links will pivot upwardly until the T link 32 moves overcenter to its FIG. 4 position. The upwardly pivoting movement of the latch links moves the push button 60 back to its original position.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. An incliner seat assembly comprising:

a frame having a pair of side members, an extending link assembly mounted on the frame, the link assembly being movable between a retracted position and an extended position, the link assembly including a seat support rail for supporting a seat, a pivot link pivotally attached to the frame, a footrest link assembly pivotallly attached to the seat support rail for movement between a retracted position and an extended position, a pusher link pivotallly attached to the footrest link assembly, latch link means movable between a latched position in which the link assembly is maintained in its retracted position and an unlatched position in which the link assembly can move to its extended position, a seat frame mounted on the seat support link, a footrest mounted on the footrest link assembly, the improvement comprising one of the side frame members being provided with an opening in the top thereof and an actuator slidably mounted in said one side frame member for generally vertical sliding movement and engageable with the latch link means, a portion of the actuator extending upwardly through the opening in said one side frame member, the actuator being movable between a raised position and a lowered position, movement of the actuator from its raised position to its lowered position causing the latch link means to move from its latched position to its unlatched position.

2. The seat assembly of claim 1 in which the actuator includes a horizontallly extending actuator rod which is engageable with the latch link means.

3. The seat assembly of claim 1 in which the actuator includes a flat panel which is slidably mounted in a generally vertical slot in the frame for generally vertical sliding movement and a generally horizontally extending actuator rod which extends transversely from the flat panel over the latch link means, the actuator rod being engageable with the latch link means as the actuator moves from its raised position to its lowered position.

4. The seat assembly of claim 1 including a seat cushion supported by the seat frame and covering the actuator.

* * * * *